US006951497B1

(12) United States Patent
Ngan

(10) Patent No.: US 6,951,497 B1
(45) Date of Patent: Oct. 4, 2005

(54) TOY VEHICLE INTERSECTION WITH ELEVATIONAL ADJUSTMENT

(75) Inventor: Roger Ngan, Diamond Bar, CA (US)

(73) Assignee: Maisto International, Inc., Fontana, CA (US)

( * ) Notice: Subject to any disclaimer, the term of this patent is extended or adjusted under 35 U.S.C. 154(b) by 0 days.

(21) Appl. No.: 10/455,979

(22) Filed: Jun. 5, 2003

(51) Int. Cl.[7] ..... A63H 18/00
(52) U.S. Cl. ..... 446/444; 446/429
(58) Field of Search ..... 446/444, 6, 429, 446/430, 431, 434, 435, 461, 463, 646; 248/237, 248/148; 463/63, 64, 66–69; 273/129 V, 273/127 A

(56) References Cited

U.S. PATENT DOCUMENTS

| | | | |
|---|---|---|---|
| 2,522,160 | A | 9/1950 | Borchers |
| 2,604,055 | A | 7/1952 | Snowden |
| 3,469,340 | A | 9/1969 | Breneman et al. |
| 3,590,524 | A | 7/1971 | Beny et al. |
| 3,599,365 | A | 8/1971 | Carver et al. |
| 3,641,704 | A | 2/1972 | Sims et al. |
| 4,070,024 | A | 1/1978 | Hamano |
| 4,108,437 | A | 8/1978 | DeAnda et al. |
| 4,174,587 | A | 11/1979 | Morin et al. |
| 4,397,465 | A | 8/1983 | Gable |
| 4,403,440 | A | 9/1983 | Wulff |
| 4,425,735 | A | 1/1984 | Kulesza et al. |
| 4,513,967 | A | 4/1985 | Halford et al. |
| 4,519,789 | A | 5/1985 | Halford et al. |
| 4,558,867 | A | 12/1985 | Hippely |
| 4,605,230 | A | 8/1986 | Halford et al. |
| 4,690,658 | A | 9/1987 | Crosson et al. |
| 5,052,972 | A | 10/1991 | Suimon et al. |
| 5,052,973 | A | 10/1991 | Rudell et al. |
| 5,102,133 | A | 4/1992 | Chilton et al. |
| 5,165,347 | A | 11/1992 | Wagner |
| 5,205,554 | A | 4/1993 | Copson |
| 5,234,216 | A | 8/1993 | Ostendorff |
| 5,299,969 | A | 4/1994 | Zaruba |
| 5,433,641 | A | 7/1995 | Rudell et al. |
| 5,800,272 | A | 9/1998 | Pons |
| 5,899,789 | A | 5/1999 | Rehkemper et al. |
| 6,000,992 | A | 12/1999 | Lambert |
| 6,062,942 | A | 5/2000 | Ogihara |
| 6,089,951 | A | 7/2000 | Ostendorff |
| 6,170,754 | B1 | 1/2001 | Halford |
| 6,241,573 | B1 | 6/2001 | Ostendorff et al. |
| 6,435,929 | B1 | 8/2002 | Halford |

*Primary Examiner*—Derris H. Banks
*Assistant Examiner*—J Williams
(74) *Attorney, Agent, or Firm*—Donn K. Harms

(57) ABSTRACT

An intersection adapted for engagement with a toy racetrack to provide an combination jump and overcrossing intersection for vehicles traversing the racetrack. The device features first and second supports engageable with inline pairs of track thereby forming two pathways across a jump formed by a gap in the middle of the device. The first support is in a translatable engagement with the second support between a first position where vehicles crossing the gap at the same time would collide and a second position forming a second path where vehicles jumping the gap are on different trajectories.

12 Claims, 1 Drawing Sheet

TOY VEHICLE INTERSECTION WITH ELEVATIONAL ADJUSTMENT

FIELD OF THE INVENTION

This invention relates to the field of toy car tracks. More particularly it relates to the intersections used as crossovers used in figure-eight and other car race tracks where the roadway traversed by the toy vehicles crosses over itself. The device provides a user adjustable intersection to allow vehicles traveling the roadway to crash at the intersection or pass adjacent to each other at different elevations.

BACKGROUND OF THE INVENTION

Toy vehicles such as toy cars which engage and move about toy race tracks are well known in the art. Many such toy vehicle sets with cars and tracks have been produced for kids and adults alike in the last century. Such toy vehicle sets generally use some sort of electrical or mechanical acceleration means to provide power to the toy vehicle on the roadway forming the racetrack to allow them to circumnavigate the track and to allow kids and adults alike to race their respective vehicles. One type, generally known for years as "slot cars", uses a multiple rail system imbedded in the track which is electrified to communicate electrical power to motors mounted in toy cars which are also engaged in a slot on the track which keeps the cars in registered engagement with the power provided by the energized rails. Slot cars are generally used by older children and adults due to the presence of electricity and the need to engage the track set with AC power to run transformers which deliver power to the energized rails.

The other popular type of toy car race set employs cars which have no onboard motor or engine and move about the track and have no slot to engage the toy cars with the track but instead use a track with side rails to keep the cars on the track so long as they are not over accelerated. Such toy cars generally use inertia of the cars themselves for propulsion around the finite confines of the track. This inertial force is conventionally generated by some type of frictionally or other car engaging device which momentarily engages with the toy car, thereby propelling the toy car down the track. Such propulsion devices include rubber bands, compressed air, gravity, springs engaging push rails, and rotating wheels which frictionally engage the sides of the vehicles moving about the assembled track.

Many roadways forming such racetracks for toy vehicles feature multiple elevations and intersections where the roadway forming the track crosses over itself. Such intersections are used in many configurations of the racetrack to conserve on space or to make the track more challenging. The classic "figure eight" style track is an excellent example where the toy vehicles race around a track in the shape of the numeral eight, crossing paths at a center point.

In recent years, it has become ever more popular for users to play with more stimulating race tracks featuring different types of obstacles for the racers. Such tracks include crash simulating tracks which also feature race tracks which include jumps, loops, and other perils which the toy vehicles must traverse during the course of travel. Players of such toy vehicle race sets are continually seeking tracks with challenges to their driving skills. However, tracks with figure eight crossovers typically cannot be changed to avoid collisions at the interception if desired. Further, elevational crossovers cannot be used to provide for intersecting paths for the vehicles to simulate a crash. Consequently, toy vehicle racers must either have a plurality of race tracks set up to provide the simulation desired, or, continually change the assembled parts of the forming of the racetrack and intersections to accomplish their desired configuration. Such changes are time consuming and require the user to buy a plurality of different parts to assemble the intersections and jumps which increases cost and also decreases play time when adapting from one track configuration to another.

U.S. Pat. No. 5,234,216 (Ostendorff) teaches a crash simulating play set with a jump where upon landing the toy vehicle making the jump crashes into stationary toy vehicles. However, Ostendorff as taught is not adaptable for race tracks since the crashed vehicle hits stationary vehicles at an intersection.

U.S. Pat. No. 4,513,967 (Halford) teaches a toy vehicle set having a single intersection and four different approaches from independent accelerators. Halford is also not adaptable for racetrack type simulations since the toy vehicles are unable to circumnavigate a track but only proceed from a start to the intersection and there is no return to the start. Neither may Halford be adjusted at the point of the intersection to avoid a crash if such is desired by the participants.

U.S. Pat. No. 45,205,554 (Copson) discloses a race track for toy vehicles which promotes collisions at a plurality of intersections of the roadway forming the track. However, Copson provides no jumps to traverse nor does it provide any means to adjust the intersections to avoid collisions if such a racetrack is desired by the participants.

As such, there exists a need for a toy car race track intersection that will provide a crossover intersection for assembled racetrack courses and provides a jump that may be traversed by the vehicles at the intersection in one of two paths. Such a device would provide the jump between the sections of roadway forming the interception. Such a device should provide for such a jump and intersection which is adjustable for elevation to encourage collisions by crossing vehicles or avoid them totally by providing paths on separate elevations. Such an intersection device should be easily adjustable from the collision setting to the crossover setting without the need to dissemble the race track pieces.

SUMMARY OF THE INVENTION

The device herein disclosed is an interchange for a toy vehicle racetrack which is adapted for cooperative engagement with the pieces of track forming the roadway of the racetrack. The device creates a four-way jumping intersection where the roadway forming the racetrack crosses over itself.

As herein disclosed, the device, once attached to the tracks forming a jump at the four way intersection, may be adjusted from a first position where vehicles traversing the gap are at substantially the same elevation to a second position where vehicles on jumping the gap between the four tracks traverse at different elevations.

When set to the first position with the path between the two overcrossing roadways substantially intersecting, vehicles traversing the intersection by jumping the gap will do so at substantially the same elevation. Should two toy vehicles reach the two entry points and traverse the jump therebetween concurrently, they will collide as they are at the same elevation.

The device, when adjusted to the second position, places the two entry points of the intersection at different levels while concurrently keeping the respective landing sections of the respective roadways at the correct elevation to provide the best landing for vehicles traversing the gap in a jump from their respective entry points to avoid bouncing on the landing on the roadway. Consequently, toy vehicles jumping the intersection will do so, crossing at different elevations, and their trajectory across the gap will be at different elevations. However, both pathways of the two jumping vehicles will have their respective landing zones located in relation to their entry points, to allow for a smooth landing of the jumping vehicles.

Once engaged with the track pieces forming the roadway of the race track, the device need not be disengaged from the race track to adjust from the crash position to the pass position. Instead, it may be raised or lowered with the track engaged with all four co-operating edges and provide the user the ability to go from a crash setting to a pass setting easily and without any time consuming disassembly. Still further, in a current preferred embodiment, the device is formed of two co-operatively engaged cylindrical base portions which allows for the adjustment of the angle by rotation of the engagement of the two pieces, thereby changing the angle of the intersection formed by the device at the crossover point.

An object of this invention is the provision of a toy car intersection which provides a jump for the toy cars to traverse.

Another object of this invention is the provision of such a toy vehicle track intersection which is easily adjustable from a position encouraging crashes between the traversing vehicles to a position where such collisions are avoided.

An additional object of this invention is the provision of such a toy vehicle track intersection which provides the proper elevation of both approaching roadways above or below the landing section of the roadways in either the crash encouraging position or the crash avoidance position.

Yet another object of this invention is the provision of a toy vehicle track intersection that need not be detached to adjust from the crash to the pass position and allows for an adjustment of the angles of the crossover of the two lanes.

These together with other objects and advantages which will become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
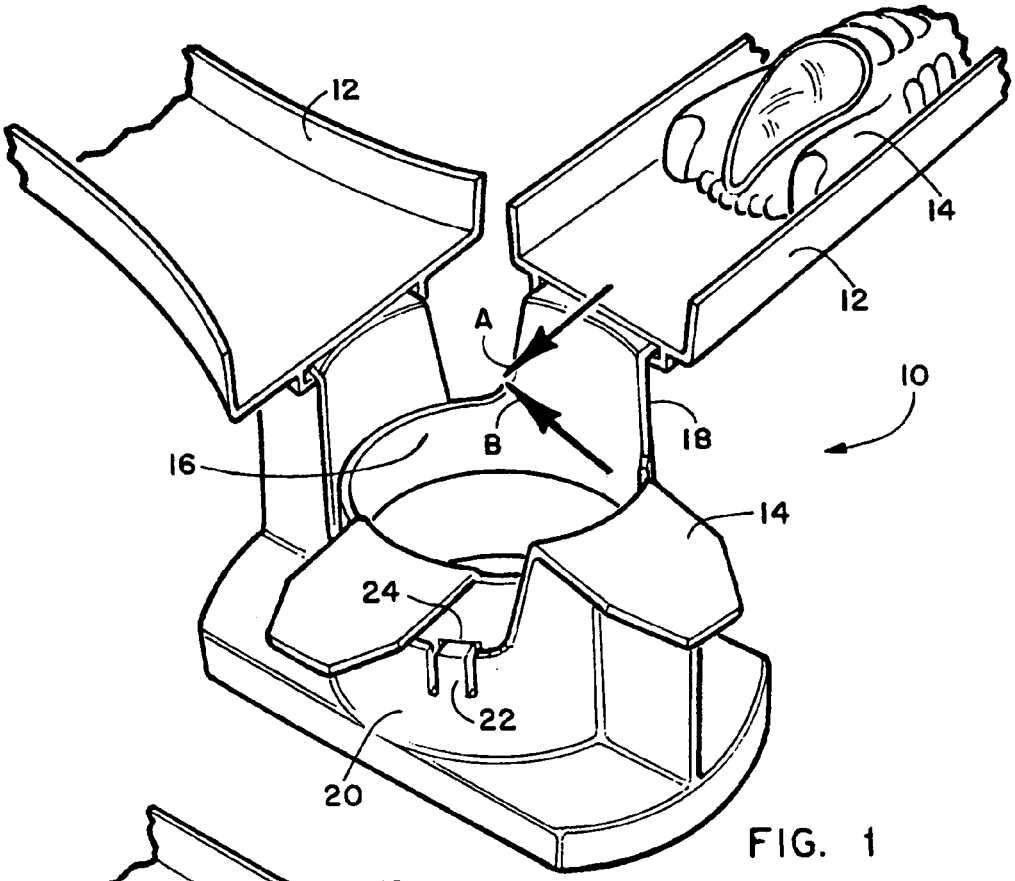
FIG. 1 depicts a perspective view of the toy racetrack intersection device in a first position where vehicles traversing the intersection would do so at substantially the same elevation thereby encouraging collisions therebetween.

Referring now to drawings 1–2, wherein similar parts of the invention are identified by like reference numerals, there is seen in FIG. 1 the disclosed intersection device 10 which is adapted for engagement with four sections of the roadway 12 formed of conventional toy race track pieces which engage each other to form a racetrack for the toy vehicles 14. Generally pieces of racetrack for toy vehicles are frictionally engaged and in the disclosed device 10 a means for engagement of the device 10 in the form of a tongue 14 would be used to co-operatively attach to the roadway 12 at all four points of the intersection. However, those skilled in the art will realize that the device 10 can be adapted for engagement with any racetrack roadway 10 for toy vehicles 14 by adapting the means for engagement of the device 10 to the roadway 12 to the particular configuration required and such is anticipated.

As depicted in the figures, the device 10 creates a four-way jumping intersection where the roadway 12 forming the racetrack crosses over itself at a gap 16, which is positioned between the terminating points of all four sections of the roadway 12 which cross at their attachment to the device 10. The device 10, once engaged with the distal ends of the four points of the roadway 12 which intersect, may be adjusted from a first position as best depicted in FIG. 1, where vehicles 14 traversing the gap 16 are on a first path A, across the gap 16 which is at substantially the same elevation to a second path B, traversing the gap 16 in the other direction. In this first position, with the two paths A and B for vehicles 14 traversing across the gap 16 substantially intersecting, the vehicles 14 jump the gap 16 at the intersection at substantially the same elevation. Should two toy vehicles 14 reach the gap 16 substantially concurrently, they will collide as they are at the same elevation.

Two of the sections of roadway 12 forming the first path A are held in position by a first support 18 which is removably engaged with the second support 20 using a means for releasable engagement of the first support 18 in an elevated position to the second support 20. In the current device 10 this means for releasable engagement of the first support 18 in an elevated position to the second support 20 is shown as pin 22 in the second support which is in biased engagement with a slot 24 in the first support 18 such that when the first support is pulled upward to the elevated position, the pin 22 biases toward and into the gap 24 and holds the first support 18 elevated.

Figure 2:
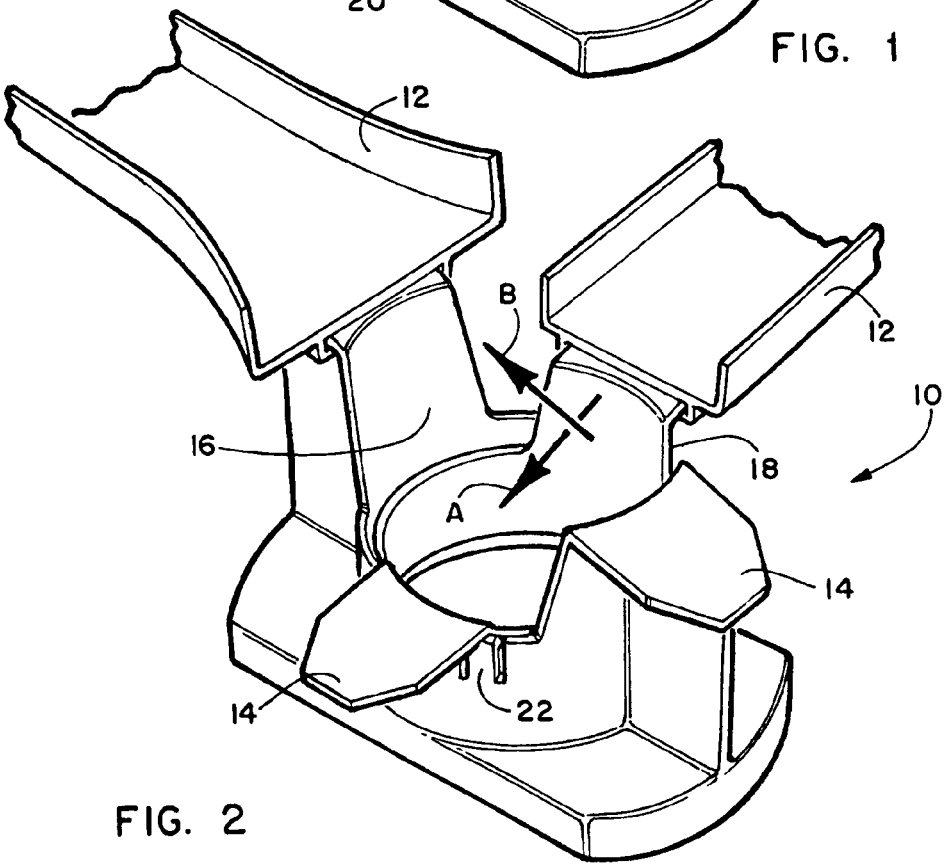
FIG. 2 shows a perspective view of the toy racetrack intersection device in a second position where vehicles traversing the intersection would do so at different elevations thereby avoiding crashes in the gap between the roadway sections.

The device is adjustable from the first position in FIG. 1 to the second position best shown in FIG. 2 by releasing pin 22 from the gap 24 and sliding the first support 18 downward in its engagement with the second support 20 thereby dropping the first support to a lowered position. This places the first path A between the first two sections of roadway 12 at a different elevation from the second path B, thereby providing different elevations for toy vehicles crossing the gap 16 at the same time. This second position of the two support in relation to each other thereby prevents or deters crashes between vehicles 14 jumping the gap 16 since they are on different elevational trajectories. Also, since both sections of roadway 12 across the gap 16 are at offset attachments to the first support 18 and second support 20, they maintain the proper elevational differences to allow for a smooth jump across the gap 16 from the entry to the landing along either of the two paths A or B.

As can be seen, because the two supports 18 and 20 are slidably engaged with each other about a common central axis, the device 10 need not be disengaged from the four connected sections of roadway 12 when adjusting from the first, or crash position, to the second or pass position. Instead, the device 10 may be adjusted between the two positions while engaged with all four co-operating edges of the connected roadway 12.

Finally, as shown in the figures, the device in one preferred embodiment, is formed of first and second supports which are two co-operatively engaged cylindrical portions which are slidable and rotatable in their engagement with each other. This also allows a means for adjustment of the angle of the cross over by rotation of the engagement of the two pieces, thereby changing the angle of the intersection formed by the device 10 at the crossover point if minor adjustments might be needed.

The device herein shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and described, may be employed to provide the toy vehicle racetrack intersection with adjustable crossing pathway elevations in accordance with the spirit of this invention. Any and all such changes, alternations and modifications as would occur to those skilled in the art are considered to be within the scope of this invention as broadly defined in the appended claims. Further, while the present invention has been described herein with reference to particular embodiments thereof, a latitude of modifications, various changes and substitutions are intended in the foregoing disclosure, and it will be appreciated that in some instances some features of the disclosed invention will be employed without a corresponding use of other features and/or in different combinations with other features without departing from the scope of the invention as set forth in the following claims.

What is claimed is:

1. An intersection apparatus adapted for engagement with a toy racetrack to provide an intersection for vehicles traversing said racetrack comprising:

a first support, said first support adapted for cooperative engagement with a first pair of sections of a toy racetrack;

a second support, said second support adapted for cooperative engagement with a second pair of sections of a toy racetrack;

a gap defined by the area between said first support and said second support;

a first pathway of travel for a toy vehicle, said first pathway communicating between said first pair of sections of toy racetrack across said gap;

a second pathway of travel for a toy vehicle, said second pathway communicating between said second pair of sections of toy racetrack across said gap;

said first support in a translatable engagement with said second support between a first position, and a second position;

means for removable engagement of said first support to said second support to maintain said first support in said first position;

said engagement of said first support and said second support in said first position thereby placing said first pathway and said second pathway at substantially equal elevations; and said engagement of said first support and said second support in said second position thereby placing said first pathway and said second pathway at substantially different elevations, whereby a two cars reaching said gap at substantially the same time will collide if said first and second support are in said first position and will not collide when said first and second support are in said second position.

2. The intersection apparatus of claim 1 wherein said means for removable engagement of said first support to said second support to maintain said first support in said first position comprises:

a pin on said second support;

means to bias said pin toward said first support; and a receiver for said pin on said first support whereby said pin is biased into said receiver when said first support and said second support are placed in said first position.

3. The intersection apparatus of claim 2 further comprising:

said first support having a cylindrical base portion adapted at a top edge for cooperative engagement with said first pair of sections of toy racetrack;

said second support having a cylindrical base portion adapted at a top edge for cooperative engagement with said second pair of sections of toy racetrack;

said cylindrical base portion of said first support being engaged with said cylindrical base portion of said second support about a common center axis; and whereby first support may remain in cooperative engagement with a first pair of sections of a toy racetrack and said second support may remain in cooperative engagement with said second pair of sections of a toy racetrack when moving from said first position to said second position.

4. The intersection apparatus of claim 2 wherein:

said first pathway of travel across said gap is at a first angle;

said second pathway of travel across said gap is at a second angle; and said first angle and said second angle remain substantially unchanged when said first support translates in its engagement with said second support between said first position and said second position.

5. The intersection apparatus of claim 3 further comprising:

means for cooperative releasable engagement of said first support with said first pair of sections of a toy racetrack having a pair of projections depending from said first support dimensioned to frictionally engage slots on said first pair of sections of toy racetrack; and means for cooperative releasable engagement of said second support with said second pair of sections of a toy racetrack having a pair of projections depending from said second support dimensioned to frictionally engage slots on said second pair of sections of toy racetrack.

6. The intersection apparatus of claim 1 wherein:

said first pathway of travel for a toy vehicle communicating between said first pair of sections of toy racetrack across said gap is at a first angle;

said second pathway of travel for a toy vehicle communicating between said second pair of sections of toy racetrack across said gap is at a second angle; and said first angle and said second angle remain substantially unchanged when said first support translates in its engagement with said second support between said first position and said second position.

7. The intersection apparatus of claim 6 further comprising:

said first support having a cylindrical base portion adapted at a top edge for cooperative engagement with said first pair of sections of toy racetrack;

said second support having a cylindrical base portion adapted at a top edge for cooperative engagement with said second pair of sections of toy racetrack;

said cylindrical base portion of said first support being engaged with said cylindrical base portion of said second support about a common center axis; and whereby first support may remain in cooperative engagement with said first pair of sections of a toy racetrack and said second support may remain in cooperative engagement with said second pair of sections of a toy racetrack when moving from said first position to said second position.

8. The intersection apparatus of claim 6 further comprising:

means for cooperative releasable engagement of said first support with said first pair of sections of a toy racetrack having a pair of projections depending from said first support dimensioned to frictionally engage slots on said first pair of sections of toy racetrack; and means for cooperative releasable engagement of said second support with said second pair of sections of a toy racetrack having a pair of projections depending from said second support dimensioned to frictionally engage slots on said second pair of sections of toy racetrack.

9. The intersection apparatus of claim 1 further comprising:

said first support having a cylindrical base portion adapted at a top edge for cooperative engagement with said first pair of sections of toy racetrack;

said second support having a cylindrical base portion adapted at a top edge for cooperative engagement with said first pair of sections of toy racetrack;

said cylindrical base portion of said first support being engaged with said cylindrical base portion of said second support about a common center axis; and whereby first support may remain in cooperative engagement with said first pair of sections of a toy racetrack and said second support may remain in cooperative engagement with said second pair of sections of a toy racetrack when moving from said first position to said second position.

10. The intersection apparatus of claim 9 further comprising:

means for cooperative releasable engagement of said first support with said first pair of sections of a toy racetrack having a pair of projections depending from said first support dimensioned to frictionally engage slots on said first pair of sections of toy racetrack; and means for cooperative releasable engagement of said second support with said second pair of sections of a toy racetrack having a pair of projections depending from said second support dimensioned to frictionally engage slots on said second pair of sections of toy racetrack.

11. The intersection apparatus of claim 1 further comprising:

means for cooperative releasable engagement of said first support with said first pair of sections of said toy racetrack; and means for cooperative releasable engagement of said second support, with said second pair of sections of said toy racetrack.

12. The intersection apparatus of claim 11 further comprising:

means for cooperative releasable engagement of said first support with said first pair of sections of a toy racetrack having a pair of projections depending from said first support dimensioned to frictionally engage slots on said first pair of sections of toy racetrack; and means for cooperative releasable engagement of said second support with said second pair of sections of a toy racetrack having a pair of projections depending from said second support dimensioned to frictionally engage slots on said second pair of sections of toy racetrack.

* * * * *